US006803045B1

(12) United States Patent
Goldberg

(10) Patent No.: US 6,803,045 B1
(45) Date of Patent: Oct. 12, 2004

(54) METHOD AND APPARATUS FOR TREATING DIAPER RASH

(76) Inventor: David Goldberg, 14 Jib St. #3, Marina Del Rey, CA (US) 90292

( * ) Notice: Subject to any disclaimer, the term of this patent is extended or adjusted under 35 U.S.C. 154(b) by 283 days.

(21) Appl. No.: 09/640,325

(22) Filed: Aug. 16, 2000

(51) Int. Cl.[7] ..... A61K 9/00
(52) U.S. Cl. ..... 424/400; 401/175
(58) Field of Search ..... 424/400, 401, 424/405; 401/175, 172

(56) References Cited

U.S. PATENT DOCUMENTS 4,816,254 A * 3/1989 Moss ..... 424/145
5,547,302 A * 8/1996 Dornbusch et al. ..... 401/172
5,879,096 A * 3/1999 Franta et al. ..... 401/175

FOREIGN PATENT DOCUMENTS

JP 10029907 * 3/1998 ..... A01N/59/16

* cited by examiner

*Primary Examiner*—Thurman K. Page
*Assistant Examiner*—Robert M. Joynes
(74) *Attorney, Agent, or Firm*—Koda & Androlia

(57) ABSTRACT

A method and apparatus for treating diaper rash including applying an anti-diaper rash cream from an applicator. The applicator includes an elongated housing containing the anti-diaper rash agent, an elliptically domed applicator portion at one end of the housing and elongated slots formed through the elliptically domed applicator portion. The anti-diaper rash agent includes zinc oxide and one or more-selected from the group consisting of aloe, vitamin E, antibacterial agent, silicon oil, petroleum.

3 Claims, 2 Drawing Sheets

METHOD AND APPARATUS FOR TREATING DIAPER RASH

BACKGROUND OF THE INVENTION

1. Field of the Invention

The present invention relates to methods and apparatuses for treating diaper rash in babies.

2. Prior Art

The present method for applying creams and the like for treating diaper rash essentially are manual direct application using the hands of the parent. In particular, cream or ointment used to treat the diaper rash is placed on the hands of the parent or directly on the skin of the baby and is rubbed into the skin of the baby using the hands of the parent. Such a method, while being effective, is messy and also provides a chance of transferring bacteria on the hands of parent to the skin of the baby. Accordingly, the direct manual application method is undesirable.

To overcome this problem, products have been provided which include a foam pad for spreading out and applying the cream or ointment to the skin of the baby. However, even while utilizing the foam pad, the cream or ointment still gets on the hands of the parent and there is still some chance of transferring bacteria from the parent to the baby, even though a smaller one. Still further, such pads are typically circular and therefore, do not fit in easily into the crevices, folds and creases of the baby's body;

SUMMARY OF THE INVENTION

Accordingly, it is a general object of the present invention to provide a method and apparatus for treating diaper rash which overcomes the disadvantages of the prior art.

In particular, it is an object of the present invention to provide a method and apparatus for treating diaper rash wherein there is no contact between the hands of the parent and the skin of the baby and the apparatus can easily fit into the creases and folds of the baby's skin.

The objects of the present invention are accomplished by a unique apparatus for applying anti-diaper rash cream or ointment. The apparatus comprises an elongated housing containing the cream or ointment and on elliptically domed applicator portion at one end of the housing with elongated slits formed through the elliptically domed applicator portion. The cream or ointment contained in the housing comprises zinc oxide, aloe, vitamin E and antibacterial agent and is of sufficient viscosity to prevent leakage from the elongated slots provided in the elliptically domed applicator portion and to allow for easy application with minimal friction to avoid skin irritation.

The method for treating diaper rash substantially comprises applying the anti-diaper rash cream from the applicator of the present invention to the affected area of the skin of the baby.

BRIEF DESCRIPTION OF THE DRAWINGS

The above-mentioned features and objects of the present invention will become more apparent from the following description, taken in conjunction with the accompanying drawings wherein like reference numerals denote like elements and in which.

DETAILED DESCRIPTION OF THE INVENTION

Figure 1:
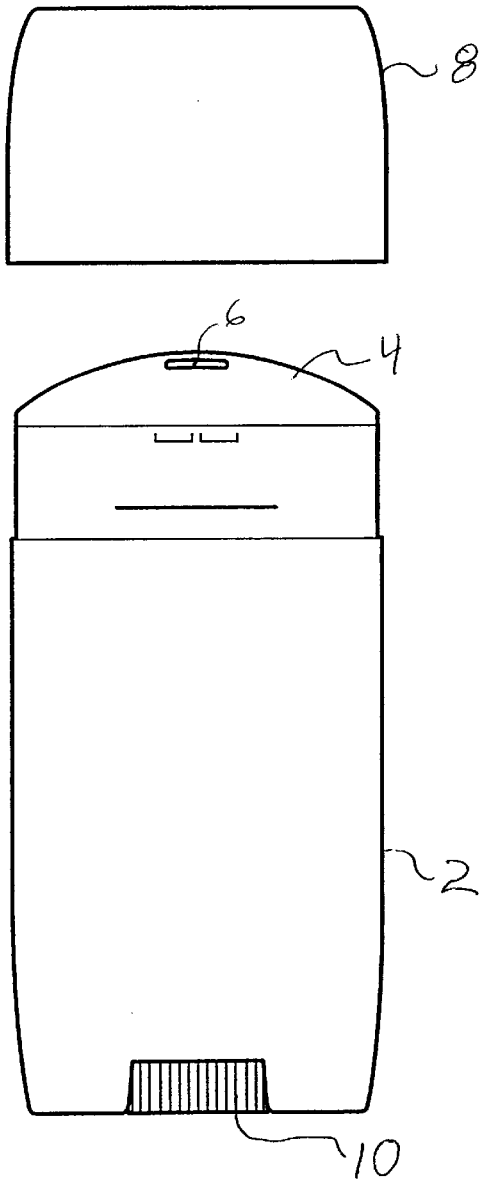
FIG. 1 is a side view of the applicator with the cap disengaged.
Figure 2:
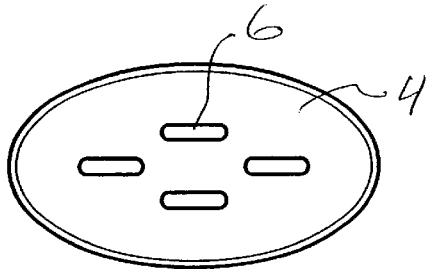
FIG. 2 is top view of the applicator with the cap removed.

Referring to FIGS. 1 and 2, shown therein are the details of the applicator of the present invention. In particular, the applicator comprises an elongated housing 2 with an elliptically domed portion 4 having an elongated slots 6 therethrough. A cap 8 for the applicator is also provided which fits over the elliptically domed portion 4 and protects it from contamination. The applicator 2 is further provided with a knurled knob 10 which is part of a dial-up mechanism well known in the art for pushing up the cream or ointment contained in the elongated housing 2.

The applicator is further designed so as to reduce the chance of bacterial contamination of both the ointment and the elliptically domed applicator portion 4. To this end, the plastic utilized for the elliptically domed applicator portion 4 is chosen to be one which is residue resistant and non-porous to reduce the chance of providing crevices and places for bacteria to grow and is made from a plastic which contains an antibacterial agent. One such plastic is Microban brand plastic pellets containing the antibacterial agent Triclosan. Also, the cap 8 is made clear or translucent to allow light exposure to the elliptically domed applicator portion 4 to also reduce the chance of the growth of bacteria or microorganisms that would flourish in a dark environment. In addition, the plastic for the elliptically domed applicator portion 4 is selected to be smooth to allow for easy application with minimal friction to prevent irritating the skin and the elliptically domed shape allows for easy navigation of the creases and the folds in the skin of the baby.

The anti-diaper rash cream or ointment comprises one or more of various skin protectants as the active ingredients. These skin protectants include zinc oxide, talc, corn starch and other FDA GRAS (Generally Recognized As Safe) substance known to those of ordinary skill in the art; however, zinc oxide is preferred. The cream or ointment may also further contain antibacterial ingredients of any type which is approved by the FDA for use in cosmetics. Such antibacterial agents include, but are not limited to, Diazolidinyl urea, methylparaben, propyl paraben, and idopropynyl butylcarbamate. Still further, the cream or ointment may contain other inactive ingredients to increase the bulk and adjust the viscosity such inactive ingredients can be selected from the group consisting of aloe vera gel, balsam peru, beeswax, benzoic acid, ceresin, FDA approved silicon oil such as Dimethicone, petroleum, fragrance, glyceryl oleate, mineral oil, PEG40 sorbitan peroliate, propylene glycol, purified water, sorbitol, vitamin E, tocopheryl and vitamin E acetate. The viscosity of the cream or ointment contained within the housing 2 must be selected to have minimal friction to avoid skin irritation on the baby in the delicate areas where diaper rash typically occur; while at the same time the viscosity must be great enough that the ointment or cream does not leak out from the elongated holes 6.

Figure 3:
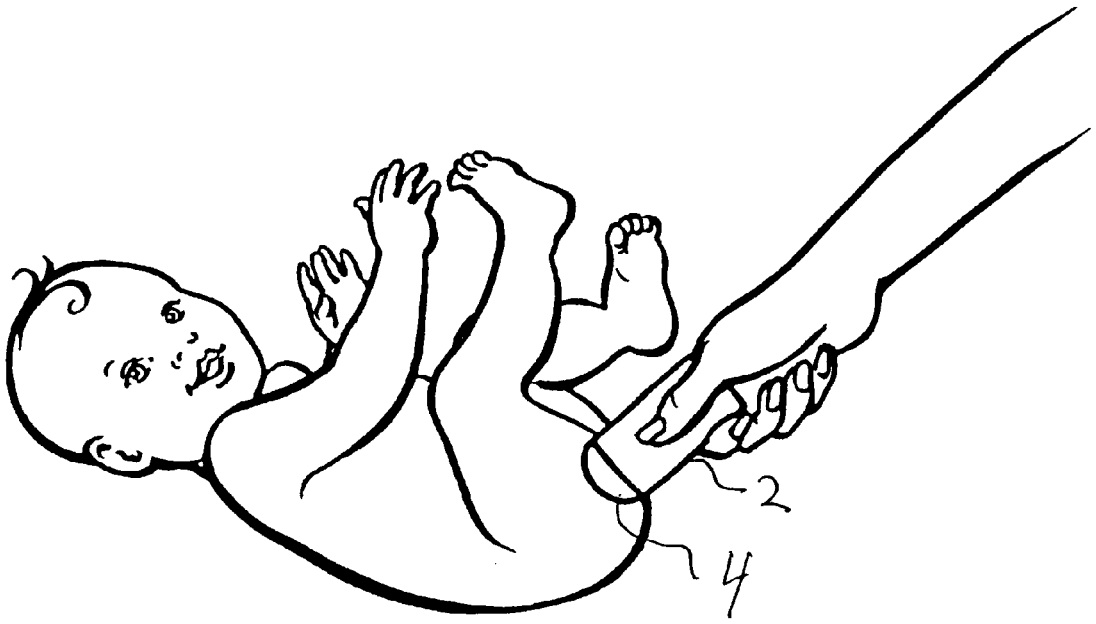
FIG. 3 is a view illustrating the use of the applicator on a baby.

Referring to FIG. 3, in operation, the cap 8 is removed from the applicator and the knob 10 is turned to force some of the cream or ointment out of the elongated slots 6 in the elliptically domed portion 4. The cream or ointment is then directly applied to the baby and spread utilizing the elliptically domed applicator portion as is shown in FIG. 3. Since both the applicator and formula have been created to minimize friction, skin irritation of the baby is reduced or prevented. Still further, since the elliptically domed portion 4 of the applicator has its desirable shape, the cream or ointment easily spread into the creases and folds of the baby's skin. Also, and as is apparent from FIG. 3, the ointment or cream can be easily applied without any ointment getting on the parent's hands or contact between the parent's hands and the skin of the baby. Therefore, any mess on the parent is greatly reduced and the chances of any bacterial transfer from the parent's hands to the baby's skin are also reduced.

It should be apparent to those skilled in the art that the above-described embodiment is one of many possible specific embodiments which can be utilized without departing from the spirit and scope of the invention. It should also be apparent to those skilled in the art that the housing 2 may be of the construction such as a push-up stick or squeeze tube.

I claim:

1. An applicator for applying an anti-diaper rash agent comprising an elongated housing containing said anti-diaper rash agent, elliptically domed applicator portion provided at one end of the housing, elongated slots from through said elliptically domed applicator portion, means for forcing said anti-diaper rash agent through said elongated slots in said elliptically domed applicator portion; and a cap for covering and protecting said elliptically domed applicator portion; and wherein said cap is made from a transparent or translucent material; and said elliptically domed applicator portion is made from a plastic containing an antibacterial agent.

2. An applicator for applying an anti-diaper rash agent comprising an elongated housing containing said anti-diaper rash agent, elliptically domed applicator portion provided at one end of the housing, elongated slots through said elliptically domed applicator portion, means for forcing said anti-diaper rash agent through said elongated slots in said elliptically domed applicator portion and a cap for covering and protecting said elliptically domed application portion; and wherein said cap is made from a transparent or translucent material to reduce the growth of bacteria or microorganisms on said elliptically domed application portion, and said elliptically domed applicator portion is made from a plastic which is residue resistant and non-porous for reducing bacterial growth on said elliptically domed applicator portion.

3. The applicator according to claim 2 wherein said elliptically domed applicator portion is made from a plastic containing antibacterial agent.

* * * * *